US011828445B2

(12) United States Patent
Ladstätter

(10) Patent No.: US 11,828,445 B2
(45) Date of Patent: Nov. 28, 2023

(54) LUMINAIRE OR ELECTRICAL UNIT FOR CONNECTION TO A SUPPORTING RAIL

(71) Applicant: ZUMTOBEL LIGHTING GMBH, Dornbirn (AT)

(72) Inventor: Gerald Ladstätter, Klaus (AT)

(73) Assignee: Zumtobel Lighting GmbH, Dornbirn (AT)

( * ) Notice: Subject to any disclaimer, the term of this patent is extended or adjusted under 35 U.S.C. 154(b) by 0 days.

(21) Appl. No.: 17/765,544

(22) PCT Filed: Oct. 1, 2020

(86) PCT No.: PCT/EP2020/077501
§ 371 (c)(1),
(2) Date: Mar. 31, 2022

(87) PCT Pub. No.: WO2021/069296
PCT Pub. Date: Apr. 15, 2021

(65) Prior Publication Data

US 2022/0364713 A1 Nov. 17, 2022

(30) Foreign Application Priority Data

Oct. 8, 2019 (DE) ..... 10 2019 126 943.1

(51) Int. Cl.
*F21V 21/35* (2006.01)
*F21S 4/20* (2016.01)
(Continued)

(52) U.S. Cl.
CPC ..... *F21V 21/35* (2013.01); *F21S 4/20* (2016.01); *F21V 23/06* (2013.01); *H01R 9/2608* (2013.01);
(Continued)

(58) Field of Classification Search
CPC . F21V 21/34; F21V 21/25; F21S 4/20; H01R 9/26; H01R 9/2608; H01R 9/2675; H01R 13/193; H01R 25/14
(Continued)

(56) References Cited

U.S. PATENT DOCUMENTS

2015/0079824 A1* 3/2015 Dinnebier ..... H01R 13/44 439/121

FOREIGN PATENT DOCUMENTS

DE 2132133 3/1972
DE 2114911 A1 * 9/1972
(Continued)

OTHER PUBLICATIONS

PCT/EP2020/077501, International Search Report and Written Opinion dated Jan. 19, 2021, 5 pages.

*Primary Examiner* — Laura K Tso
(74) *Attorney, Agent, or Firm* — Andrus Intellectual Property Law, LLP

(57) ABSTRACT

A luminaire (30) or electrical unit for connection to a supporting rail (10) has a contacting element (40, 50, 60), which is introducible into the supporting rail profile (15) and has connection contacts (42, 52, 62) mounted adjustably in order to bear against lines (25) of the busbar (20) in a state in which the contacting element (40, 50, 60) has been inserted into the supporting rail profile (15). The contacting element (40, 50, 60) has at least one contact block (41, 42, 51, 52, 61, 62) with connection contacts (43, 53, 63), which is linearly laterally adjustable between an open position and a contacting position.

15 Claims, 4 Drawing Sheets

(51) Int. Cl.

| | |
|---|---|
| ***F21V 23/06*** | (2006.01) |
| ***H01R 9/26*** | (2006.01) |
| ***H01R 13/193*** | (2006.01) |
| ***H01R 25/14*** | (2006.01) |

(52) U.S. Cl.
CPC ..... *H01R 9/2675* (2013.01); *H01R 13/193* (2013.01); *H01R 25/14* (2013.01)

(58) Field of Classification Search
USPC ..... 439/116, 259, 261; 362/217.14
See application file for complete search history.

(56) References Cited

FOREIGN PATENT DOCUMENTS

| | | |
|---|---|---|
| DE | 10 2010 003 805 | 10/2011 |
| DE | 20 2013 102943 | 7/2014 |
| WO | 2001091250 | 12/2001 |

* cited by examiner

LUMINAIRE OR ELECTRICAL UNIT FOR CONNECTION TO A SUPPORTING RAIL

CROSS-REFERENCE TO RELATED APPLICATION

The present application is the U.S. national stage application of international application PCT/EP2020/077501 filed Oct. 1, 2020, which international application was published on Apr. 15, 2021 as International Publication WO 2021/069296 A1. The international application claims priority to German Patent Application 10 2019 126 943.1 filed Oct. 8, 2019.

FIELD OF THE INVENTION

The present invention relates to a luminaire or electrical unit provided for connection to a supporting rail, wherein the supporting rail comprises a supporting rail profile having two lateral walls as well as at least one busbar arranged in the supporting rail profile, having contactable cables.

Supporting rails having a supporting rail profile as well as a busbar retained in the supporting rail profile are known from the prior art and are used, for example, to implement elongated so-called light strip systems. A known light strip system is sold by the Applicant under the name "TECTON" and is characterized in that luminaires or other electric consumers can be flexibly positioned on the supporting rail over the entire length of the system. This is made possible by the fact that, due to a special mounting of the lines of the busbar, they are accessible to the consumers over the substantially entire length of the light strip system, so that contacting of the lines can occur not only at fixed predetermined positions, but rather at any desired location. For example, WO 2001/091250 A1 shows such a light strip system.

SUMMARY OF THE INVENTION

In the "TECTON" system mentioned above, two busbars are arranged opposite one another on the two lateral walls of a U-shaped supporting rail profile, which opens downwardly. The contacting of the lines of the busbars is then carried out in that the luminaire or the consumer comprises a rotatable contacting element, which is inserted into the supporting rail from the bottom and subsequently rotated by approximately 45°. Contacts arranged on the contacting element are designed in such a way that they are laterally pivoted outward by rotation and ultimately contact the lines of the busbars in the rotated state.

Originally, the above-described rotatable contacting elements were designed and mounted on the luminaire or the electric consumer such that they could be actuated, i.e., rotated, from the bottom of the luminaire by a user. The luminaire or a supporting element of the luminaire or the consumer was then attached to the supporting rail from the bottom, wherein the contacting element(s) was/were then rotated in the state bearing against the supporting rail. In this case, the contacting elements had to be accessible for actuation from the bottom of the luminaire or the consumer, which usually did not pose a problem, because elongated fluorescent lamps were generally used as illuminants, which could only be inserted into the luminaire's sockets in a simple manner by the consumer after fastening the luminaire to the supporting rail.

In the meantime, however, in illumination technology, LEDs and/or LED boards are primarily used as illuminants, also in the case of luminaires intended for use in such supporting rails. Because the subsequent arrangement of LED illuminants on a luminaire is rather not useful or possible and an even luminaire output can also only be achieved when the LEDs are more or less continuously evenly distributed over the entire length of the light strip system, it is generally no longer possible to design the aforementioned rotatable contacting elements such that they are accessible from the bottom.

A solution described in DE 10 2010 003 805 A1, for example, therefore provides that the rotatable contacting element is designed with a lever that projects laterally outward through a slot of the carrier element of the luminaire.

Such a solution known from the prior art is shown in FIG. 4, wherein first the elongated carrier element 110 of a so-called bar luminaire 100 is seen, on which a contacting element 120 is rotatably supported. The support element 110, which is present in the form of a profile element, must be attached to the supporting rail (not shown) of the light strip system in order to mount the luminaire 100 from the bottom, and then the contacting element 120 is rotated. For this purpose, the supporting element 110 has lateral walls 111 on both longitudinal sides, wherein an elongated slot 112 is formed on a lateral wall 111, through which slot the end region of a lever 125 connected to the contacting element 120 projects. The lever 125 can be pivoted along the slot 112 between the two positions shown, wherein the contacting element 120 is then rotated accordingly. In this case, contacts 122 of the contacting element 120 arranged on the outer circumference of the base body 121 are then pivoted laterally outward so that they come into contact with the lines of the busbars. At the same time, mechanical interlocking elements are also pivoted outwardly in this case, which rearrange the corresponding projections of the supporting rail profile so that a mechanical fastening of the luminaire 100 to the supporting rail is achieved in addition to the electrical contacting.

The laterally projecting lever 125 shown in FIG. 4 thus allows the contacting element 120 to be rotated, wherein, despite everything, the bottom of the carrier element 110 of the luminaire 100 is freely accessible and can thus be equipped with illuminants, for example over the entire length. Accordingly, this solution already represents progress against the original variant in which the interlocking element had to be actuated from the bottom.

However, in the solution from the prior art shown in FIG. 4, the lever 125 has to protrude laterally to a certain extent in order to enable comfortable actuation of the contacting element 120. Further, the lateral slit 112 constitutes a permanent opening and thus poses a problem when the luminaire 100 is to be protected from ingress of dust and/or moisture in order to meet the requirements of a so-called IP protective class.

The underlying problem of the present invention is therefore to offer an alternative option for reliably contacting the lines of a busbar positioned in a supporting rail profile, wherein the aforementioned disadvantages are to be avoided.

The problem is solved by a luminaire or an electrical unit having the features of claim 1. Further, the problem is solved by a contacting element having the features of claim 15. Advantageous further developments of the invention are the subject matter of the dependent claims.

The solution according to the invention is based on the idea of replacing the rotational movement used thus far in the known contacting elements with linearly laterally extending movements of the contacts. The individual connection contacts are now not arranged on a rotatable body, but rather are a component of a linearly laterally adjustable contact block, which is adjustable between an open position, in which the contacting element is enabled to be inserted and removed from the supporting rail profile, and a contacting position in which the contact block with the connection contacts is extended laterally for contacting the lines. As explained in detail below with the aid of several exemplary embodiments, in this case, a reliable and efficient contacting of the lines of the busbar and in addition a mechanical fastening to the supporting rail can be achieved, wherein, however, the lever used in the prior art or generally the actuation elements, which project laterally through openings or breakthroughs in the luminaire, can be omitted. The disadvantages in the prior art as described above can thus be avoided.

According to the present invention, a luminaire or an electrical unit for a supporting rail is proposed, which has a supporting rail profile with two lateral walls as well as at least one busbar, which is arranged on one of the two inner faces of the lateral walls of the supporting rail profile and comprises electrically contactable lines, wherein the luminaire or the electrical unit comprises a contacting element for the electrical and, if necessary, mechanical connection to the supporting rail, and wherein the contacting element is introducible into the supporting rail profile and comprises connection contacts, which are adjustable in order to be brought to bear against lines of the busbar in a state of the contacting element after it has been inserted into the supporting rail profile. According to the invention, the contacting element comprises at least one linearly laterally adjustable contact block with at least one connection contact, which is adjustable between an open position, in which an insertion and removal of the contacting element from the supporting rail profile is made possible, and a contacting position, in which the contact block with the connection contact is extended laterally in order to contact the lines.

Furthermore, according to the present invention, a contacting element is proposed for electrically and mechanically connecting a luminaire or an electrical unit to a supporting rail, which has a supporting rail profile with two lateral walls as well as at least one busbar, which is arranged on one of the two inner faces of the lateral walls of the supporting rail profile and comprises electrically contactable lines, wherein the contacting element is introducible into the supporting rail profile and comprises connection contacts, which are adjustably mounted in order to be brought to bear against lines of the busbar in a state of the contacting element after it has been inserted into the supporting rail profile, and wherein, according to the present invention, the contacting element comprises at least one linearly laterally adjustable contact block having at least one connection contact, which is adjustable between an open position, in which an insertion and removal of the contacting element from the support profile is enabled, and a contacting position, in which the contact block with the connection contact is extended laterally for contacting the lines.

It is preferably provided that the contacting element comprises two contact blocks with connection contacts facing in opposite directions, wherein the two contact blocks are coupled such that they can be transferred from the open position into the contacting position while moving away from one another. This configuration is particularly suitable when corresponding busbars are arranged on both lateral walls of the supporting rail, as is the case in the above-mentioned "TECTON" system, for example. Both contact blocks can then move in opposite directions or towards one another in order to perform a transfer of the contacting element from a state in which an insertion into the supporting rail or removal from the supporting rail is possible into a state in which the lines of the busbars are contacted. The two contact blocks can advantageously cooperate with one another in order to use the linear movement according to the invention for contacting the lines.

In a first exemplary embodiment of the invention, it is provided that the two contact blocks are connected to one another via articulated arms that form a parallel guide. In particular, it can then be provided that the two contact blocks are supported in a biased manner in the contacting position, wherein suitable pressure elements or actuating elements are arranged on the contacting element or on a supporting element of the luminaire or the electrical unit, which pressure or actuating elements allow the contact blocks to be manually compressed into the open position. Merely for the insertion or removal of the contacting element from the supporting rail, therefore, the two contact blocks must temporarily be compressed. If, on the other hand, the pressure or actuating elements are unburdened, the contact blocks automatically elongate laterally in order to contact the lines of the busbars.

Another preferred embodiment of the invention, on the other hand, provides that the contacting element is configured such that a movement directed axially into the supporting rail profile is converted into a lateral movement of the two contact blocks.

According to a first variant, it can be provided in this case that the two contact blocks are connected to one another via articulated arms that form a toggle joint. In particular, the toggle joint can be designed such that, upon application of pressure to the contact blocks in a direction opposite to the direction of insertion into the supporting rail profile, the contact blocks are transferred from the open position into the contacting position. When inserting the contacting element into the supporting rail, the contact blocks automatically elongate laterally into the contacting position, which constitutes a particularly efficient and comfortable configuration of the contacting element according to the invention.

On the other hand, a solution comparable to the variant just described provides that the two contact blocks are supported on a carrier of the luminaire or the electrical unit by means of a wedge guide such that, when pressure is applied to the contact blocks in a direction opposite to the direction of insertion into the supporting rail profile, the contact blocks are forced from the open position into the contact position by a wedge arranged on the carrier. In this case, too, the insertion movement is automatically used in order to move the contact blocks laterally into the contacting position.

In both of the variants just described, it can be provided that the contact blocks are biased into the open position, and in particular connected to one another via a tension spring.

In addition to the contacts for contacting the lines of the busbars, the contact blocks of the contacting element according to the invention can further comprise detent elements facing outwardly for mechanical fastening to the supporting rail profile. In the same way as in the prior art, the effect can also be achieved in this case that, in addition to contacting the lines of the busbars, the luminaire or the electrical unit is also mechanically fastened to the supporting rail profile at the same time.

At least one of the contacts of the contacting element according to the invention can be mounted on its contact block in a height-adjustable manner. This opens up the possibility of flexibly contacting the different lines of the busbars in order to selectively assign a specific function to the consumer or the luminaire, for example.

Preferably, the luminaire according to the invention is an LED bar luminaire. The design of the contacting element according to the invention thus opens up the possibility of continuously arranging LEDs as illuminants over the entire length of the luminaire.

According to the present invention, an arrangement for the output of luminaire with a supporting rail is proposed, which comprises a supporting rail profile having two lateral walls, as well as at least one busbar, which is arranged on one of the two inner faces of the lateral walls of the supporting rail profile and comprises electrically contactable lines, wherein a luminaire or an electrical unit as described above is further present. Preferably, busbars are arranged on both sides of the supporting rails.

BRIEF DESCRIPTION OF THE DRAWINGS

The invention will be explained in further detail in the following with reference to the accompanying drawings. The figures show.

DETAILED DESCRIPTION

Figure 1B:
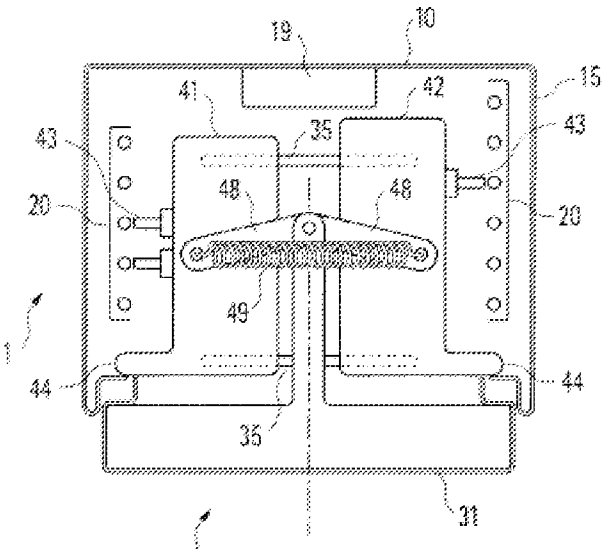
FIGS. 1*a* and 1*b* is a first exemplary embodiment of a contacting element according to the invention for a bar luminaire to be connected to a supporting rail.

The following detailed explanation of the exemplary embodiments according to the invention assumes a light strip system that substantially corresponds to the light strip system "TECTON" already mentioned above in terms of its design. A particular feature of this system is that the lines extending along the supporting rail for supplying power to the luminaires or consumers are supported such that they can be contacted over the entire length of the light strip system, so that luminaires or other consumers can be flexibly arranged over the length of the light strip system. However, it should be noted that the present invention is not limited to this particular light strip system, but rather the contacting elements according to the invention can, in principle, always be used when, in order to contact the lines of a supporting rail of a light strip system, corresponding contacts of the contacting element must be moved laterally in order to contact the lines of a busbar. In the figures explained in more detail below, the supporting rail with the busbars arranged therein is therefore only shown schematically.

It should also be noted that a contacting of the lines of a busbar does not necessarily have to serve to supply power to the unit to be connected. The connection to data lines used for communication would also be conceivable, wherein, in particular, the connection of sensors, cameras, or similar components that transmit data via the lines of the light strip system would also be conceivable, which are then used, for example, for automated control of the system. In this sense, the present invention encompasses all conceivable electrical units that can be connected to a busbar in a sensible manner.

According to the illustrations, the supporting rail 10 of the light strip system 1 comprises a supporting element, which opens to the bottom and comprises a U-shaped supporting rail profile 15, which, together with two lateral walls 16 and a horizontal wall 17 connecting the lateral walls 16, encloses an elongated receiving space 18, into which the contacting element described in more detail below is to be inserted. Busbars 20 are arranged on both inner faces of the lateral walls 16 with contactable lines 25, which are contactable by the luminaires or other electrical units to be connected to the system 1. As is already known from the prior art, the mounting of the lines 25 can be carried out by specially formed line retention elements consisting of an insulating material, which form elongated grooves or channels that open towards the inner face, in which the lines 25 formed by uninsulated wires are supported. In principle, the configuration of the busbars 20 could also vary. However, it is essential that the lines 25 are supported in such a way that they are accessible from the internal space 18 of the supporting rail 10 and can be contacted accordingly from this direction. However, the lines 25 need not necessarily be accessible over the entire length of the system 1, but it would also be conceivable that a contacting merely in sections is possible or provided.

Figure 1A:
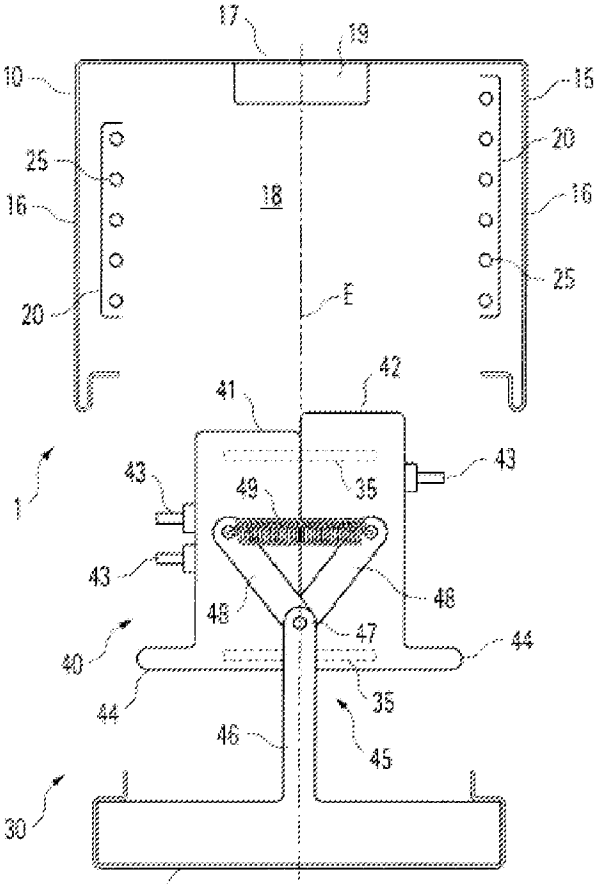

As the luminaire to be connected to the system 1, the present figures show a so-called bar luminaire 30, which bears against the bottom of the supporting rail profile 15 in the assembled state according to the illustration according to FIGS. 1*a* and 1*b* and, as a weight-bearing element, has an elongated profile body 31. In particular, the profile body 31 also serves to mount the illuminants, any components for the power supply of the illuminants, as well as any existing optical components that influence the light output of the luminaire 30 in a desired manner. However, the design of these components is independent of the present invention, for which reason these components are not shown in detail in the figures and will also not be explained in greater detail in the following.

The decisive factor is that the luminaire 30 is configured in order to be mechanically fastened to the supporting rail 10 and to contact at least some of the lines 25 of the two busbars 20, which is enabled with the aid of the contacting elements, which are described in further detail below.

In principle, the contacting elements are designed to be transferable from a first configuration into a second configuration.

In the first configuration, the contacting element is designed so that it can be inserted into the internal space 18 of the supporting rail 10 and in particular does not conflict with the lower edges of the lateral walls 16 of the supporting rail profile 15. In this state, there is also still no contacting of the lines 25 of the busbars 20.

In the second configuration, on the other hand, the contacting element is in a state in which at least some of the lines 25 of the busbars 20 are contacted. Ideally, mechanical detent or interlocking elements also engage with corresponding projections on the supporting rail 10, so that a mechanical fastening to the supporting rail 10 is also carried out, in addition to the electrical contacting. The contacting element is thus additionally responsible for fastening the unit to be connected to the supporting rail 10.

Figure 4:
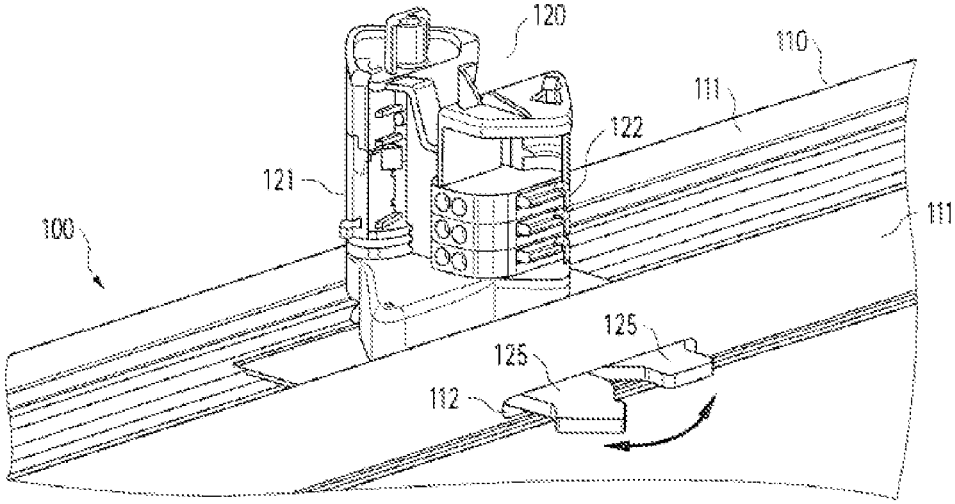
Prior art Fig. 4
FIG. 4 is a solution known from the prior art of a contacting element known for a bar luminaire to be connected to a supporting rail.

In the solution known from the prior art as shown in FIG. 4, the contacting element was transferred from the first configuration into the second configuration by rotation. According to the present invention, it is now provided that linear displacements or movements are used in order to perform the above functions, deviating from a rotation. Three preferred embodiments of this concept are to be explained in further detail below.

In FIGS. 1*a* and 1*b*, the first exemplary embodiment of a contacting element according to the invention bears the reference numeral 40. In the illustrated case, it comprises two so-called contact blocks 41 and 42, which are arranged on both sides of a longitudinal central plane E and support contacts 43 facing outwardly and in opposite directions, respectively. The number as well as the height positioning of the contacts 43 is shown merely by way of example in the figures and of course may also vary. In particular, it can also be provided that one or some of the contacts 43 are mounted in a height-adjustable manner on the corresponding blocks 41, 42, so that it can be determined by means of the corresponding positioning of the contacts 43 which of the lines 25 of the busbars 20 positioned above one another are to be contacted. If, for example, the different lines 25 are used for different phases of a power supply circuit or serve to provide a specific supply voltage or specific control information, a specific function can thereby be assigned to the luminaires or, generally, to the connected unit.

In order for the contacts 43, e.g., designed as contact tabs, to be able to contact the lines 25, there must be the possibility of extending these contacts 43 laterally. This is made possible in the first exemplary embodiment according to the invention in that the contact blocks 41, 42 are coupled to one another via a so-called toggle joint 45. This toggle joint 45 is formed by a vertically upwardly projecting first arm 46, which is rigidly connected to the carrier 31 of the luminaire 30. At its upper end, the arm 46 is connected via an articulated joint 47 to two pivotally supported arms 48, the end regions of which are each hingedly coupled to one of contact blocks 41 and 42, respectively. Furthermore, a tension spring 49 is provided, which connects the end regions of the two arms 48 to one another.

The toggle joint 45 formed in this manner now allows the two contact blocks 41 and 42 to be transferred from the position shown in FIG. 1*a*, which corresponds to an open position of the contacting element 40, into the position shown in FIG. 1*b*. As can be seen, in comparison to FIG. 1*a*, both contact blocks 41 and 42 are slightly laterally extended, such that the outer ends of the contact tabs 43 are now brought to bear against the lines 25 of the busbars 20. Furthermore, detent tabs 44 of the contact blocks 41, 42 at the lower end of the lateral walls 16 of the supporting rail 10 engage with provided detent protrusions. Thus, in this position, the luminaire 30 is not only electrically connected to the lines 25 of the busbars 20, but is also mechanically fixed to the supporting rail 10. The position of the arms 48 in the contacting position of the contact blocks 41 and 42 as shown is also such that the contact blocks 41 and 43 are locked by the tension spring 49 in the position shown.

Thus, upon axial insertion of the contacting element 40 shown, the contact blocks 41, 42, which are initially located in the position shown in FIG. 1*a*, come to bear against the horizontal wall 17 of the supporting rail 10 or with a stop 19 provided on the wall 17. If the supporting element 31 of the luminaire 30 is now pushed further upwards, the pressure exerted by the wall 17 or the stop on the contact blocks 41, 42 counter to the insertion movement leads to the conversion of this axial movement by the toggle joint 45 into a lateral deflection of the contact blocks 41 and 42, in that the arms 48 are pivoted about the pivot point 47 until they occupy the position shown in FIG. 1*b*. As already mentioned, a dead center of the joint 45 is exceeded, and the tension spring 49, which pulls the contact blocks 41 and 42 into the open position in the position shown in FIG. 1*a*, now ensures that the contact blocks 41 and 42 permanently assume the configuration shown in FIG. 1*b*. Only by exerting a powerful pull on the luminaire 30 from the bottom can the dead center of the joint 45 be overcome and the 30 luminaire removed from the supporting rail 10.

The solution shown in FIGS. 1*a* and 1*b* thus represents a very comfortable possibility for enabling a connection of the luminaire 30 to the supporting rail 10. It is only necessary to insert the luminaire 30 into the supporting rail 10 from the bottom and to push it upwards with a corresponding force in order to achieve the configuration shown in FIG. 1*b*. A release of this interlocking or contacting configuration can then be achieved again by correspondingly pulling on the luminaire 30. If necessary, the ribs 35, which are schematically shown in the figures, can also be used in addition to this, which form a guide for the lateral movement of the two contact blocks 41, 42.

Figure 2B:
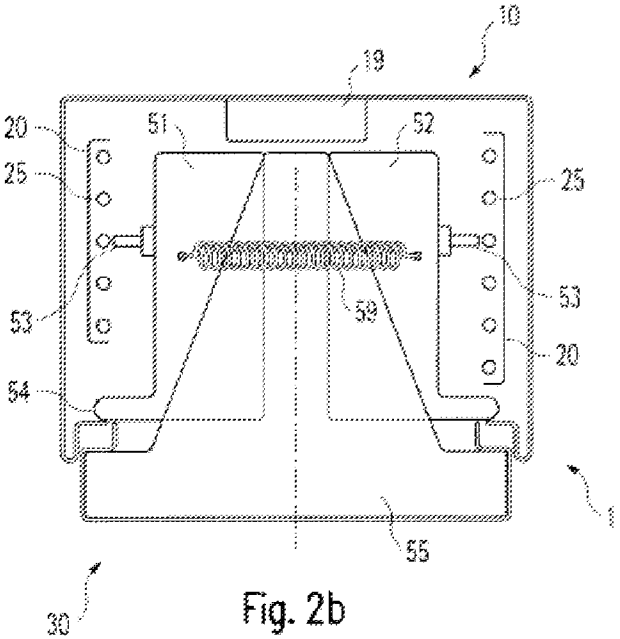
FIGS. 2*a* and 2*b* is a second exemplary embodiment of a contacting element according to the invention.
Figure 2A:
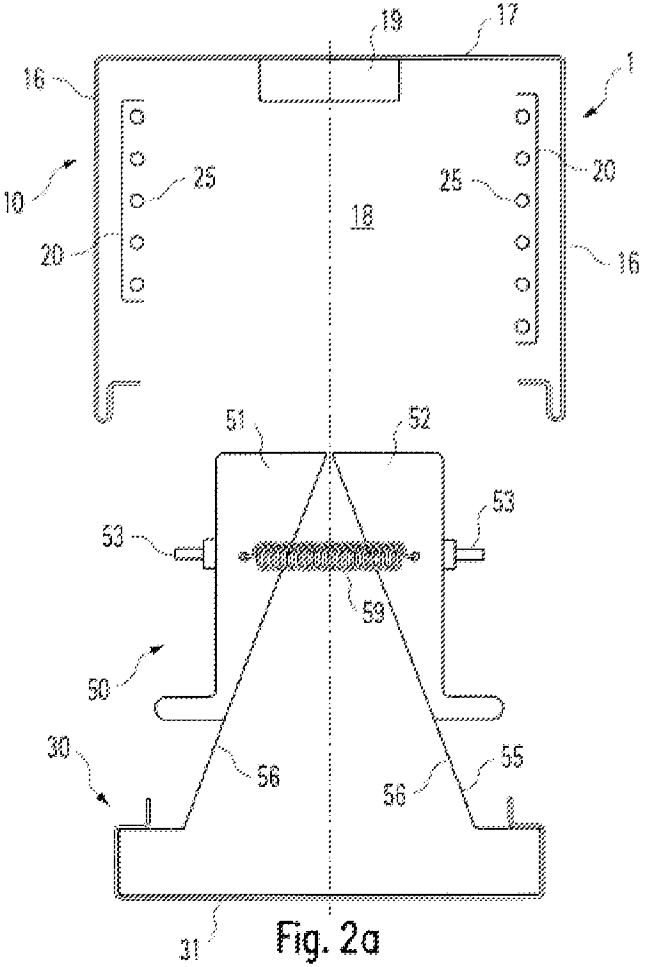

FIGS. 2*a* and 2*b* show a second exemplary embodiment of a contacting element according to the invention, now bearing the reference numeral 50. This also offers the advantage that the two contact blocks 51, 52, which are provided in turn and which are equipped with corresponding contacts 53, come to bear against a stop 19 or the wall 17 upon insertion into the receiving space 18 of the supporting rail 10 and then automatically emigrate laterally. Again, the axial insertion movement is converted into a lateral movement of the contact blocks 51, 52.

This is made possible in the second exemplary embodiment by a wedge guide for the two contact blocks 51 and 52. A guide element 55 used for this purpose, the design of which is approximately truncated in cross-section, is in turn fixedly connected to the carrier 31 of the luminaire 30 and forms two upwardly inclined projecting guide surfaces 56, along which the contact blocks 51, 52 can slide together, which are in turn connected to one another via a tension spring 59. The contact blocks 51, 52 have lateral walls facing the guide surfaces 56, which have a corresponding incline, such that a change in the height of the contact blocks 51, 52 is converted into a lateral movement compared to the guide element 55.

Analogously to the exemplary embodiment of FIGS. 1*a* and 1*b*, the contact blocks 51 and 52 first come into contact with their top sides against the wall 17 and the stop 19 when they are inserted into the internal space of the supporting rail 10. A further pushing of the luminaire 30 and thus of the contacting element 50 upwards then results in the contact blocks 51, 52 emigrating laterally until the configuration shown in FIG. 2*a* is achieved.

Then, in this case, the contact blocks 51, 52 again occupy a position in which the contacts 53 contact the lines 25 of the busbars on the one hand and detent projections 54 engage with the supporting rail 10 on the other hand. It can be provided that, by means of special detent projections or detent elements (not shown), which are provided for example on the detent tabs 54 of the contact blocks 51, 52 and cooperate in a corresponding manner with the supporting rail profile 15, the end position shown in FIG. 2*a* is secured. This detent or interlocking can then be overcome by suitably pulling on the luminaire 30, so that the luminaire 30 can in turn be easily detached from the supporting rail 10 in this way.

Figure 3B:
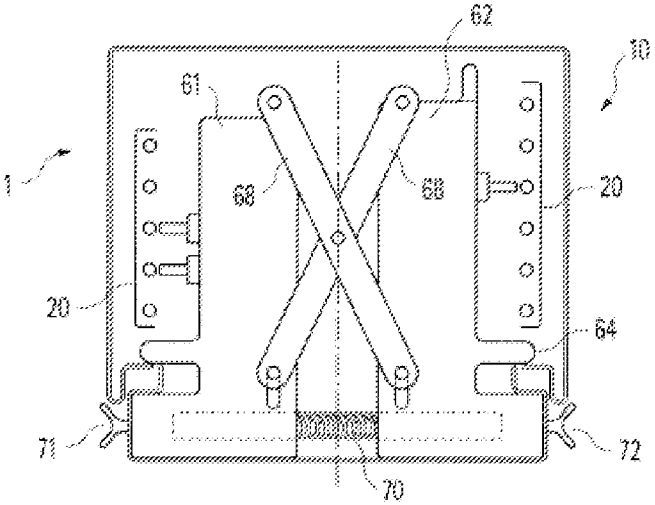
FIGS. 3*a* and 3*b* is a third exemplary embodiment of a contacting element according to the invention.
Figure 3A:
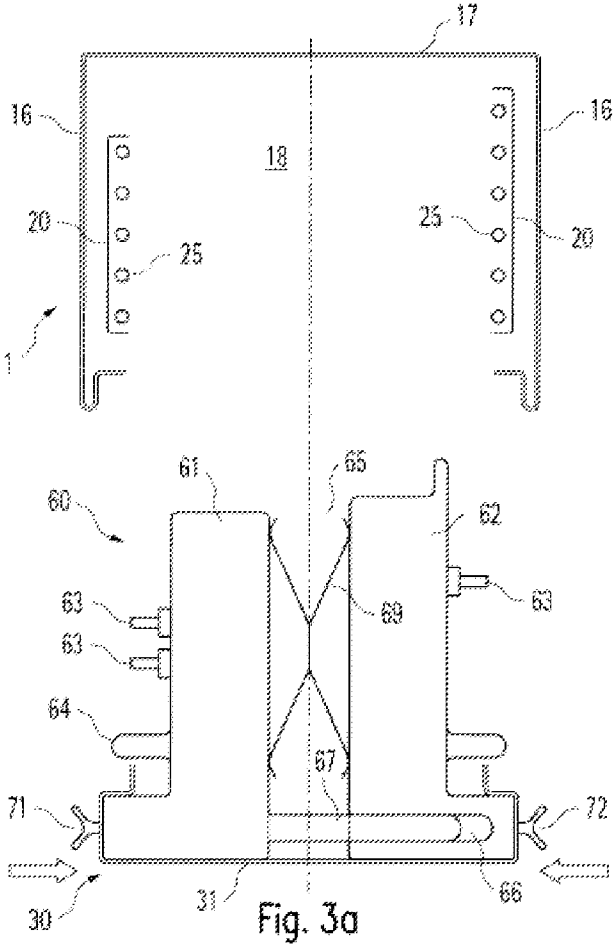

A third exemplary embodiment of a contacting element 60 according to the invention is shown in FIGS. 3*a* and 3*b*. Here, by contrast to FIGS. 1 and 2, an axial movement is not automatically converted into a lateral movement of the two contact blocks 61, 62. Instead, both contact blocks 61, 62 are connected to one another via a parallel guide 65. In both FIGS. 3*a* and 3*b*, different variants of a corresponding parallel guide 65 are shown, wherein the guide 65 in FIG. 3*a* is achieved by a rib 67 of the other contact block 61, which engages with a slot-like recess 66 of a contact block 62, whereas in the variant according to FIG. 3*b*, the parallel guide 65 is formed with the aid of two articulated arms 68.

Further, both contact blocks 61, 62 are biased into an outward facing position. In FIGS. 3*a* and 3*b*, two different possibilities are provided for this purpose: on the one hand, leaf springs 69 (FIG. 3*a*) located in the interstice between the contact blocks 61, 62, and on the other hand, a spiral spring 70 (FIG. 3*b*) positioned in the lower region. Both variants cause the contact blocks 61, 62 to be biased into the outward facing contacting position.

Thus, to insert the contacting element 60 into the internal space 18 of the supporting rail 10, it is necessary to temporarily move both contact blocks 61, 62 towards one another in opposition to the spring force, which can be carried out manually by two laterally provided pressure fields 71, 72. If these pressure fields 71, 72 are unburdened in the inserted state of the contacting element 70 in the internal space 18 of the supporting rail 10, the contact blocks 61, 62 automatically move outwardly again by the spring force and, in turn, there is a contacting of the lines 25 of the busbars 20 and also a mechanical interlocking with the supporting rail 10 via the detent elements 64.

All three variants described are thus characterized in that, in a simple but efficient manner, a contacting between busbars on the one hand and a mechanical fastening of consumers to supporting rails on the other hand is enabled. In any case, due to the fact that no rotation or pivoting of a contacting element is required, the aforementioned disadvantages in the prior art can be avoided.

The invention claimed is:

1. A luminaire (30) or electrical unit for connection to a supporting rail (10) comprising a supporting rail profile (15) having two lateral walls (16) and at least one busbar (20), which is arranged on one of the two inner faces of the lateral walls (16) of the supporting rail profile (15) and comprises electrically contactable lines (25), wherein the luminaire (30) or the electrical unit comprises a contacting element (60) for electrically and mechanically connecting to the supporting rail (10), and wherein the contacting element (60) is introducible into the supporting rail profile (15) and comprises connection contacts (62) which are mounted in an adjustable manner in order to bear against lines (25) of the busbar (20) when the contacting element (60) has been inserted in the supporting rail profile (15);

wherein the contacting element (60) comprises a spring (69, 70) and two linearly laterally adjustable contact blocks (61, 62) each having connection contacts (63), and each adjustable between an open position, in which an insertion and removal of the contacting element (60) from the supporting rail profile (15) is made possible, and a contacting position, in which the contact blocks (61, 62) with the connection contacts (63) are extended laterally outward in order to contact the lines (25);

wherein the two contact blocks (61, 62) with connection contacts (63) face in opposite directions and are coupled such that the spring exerts a force to move the contact blocks (61, 62) from the open position to the contacting position, and actuating elements (71, 72) are arranged on the contacting element (60) and provide manual access to squeeze the contact blocks (61, 62) toward each other against the force of the spring; and further wherein the spring biases the two contact blocks (61, 62) into the contacting position after the contacting element (60) has inserted into the mounting rail and the actuating elements (71, 72) have been released.

2. The luminaire or electrical unit according to claim 1, wherein the two contact blocks (61, 62) are connected to one another via a parallel guide (65).

3. A luminaire (30) or electrical unit for connection to a supporting rail (10) comprising a supporting rail profile (15) having two lateral walls (16) and at least one busbar (20), which is arranged on one of the two inner faces of the lateral walls (16) of the supporting rail profile (15) and comprises electrically contactable lines (25);

wherein the luminaire (30) or the electrical unit comprises a contacting element (40, 50) for electrically and mechanically connecting to the supporting rail (10), wherein the contacting element (40, 50) is introducible into the supporting rail profile (15) and comprises connection contacts (42, 52) which are mounted in an adjustable manner in order to bear against lines (25) of the busbar (20) in a state in which the contacting element (40, 50) has been inserted in the supporting rail profile (15);

wherein the contacting element (40, 50) comprises at least one linearly laterally adjustable contact block (41, 42, 51, 52) having connection contacts (43, 53), which block is adjustable between an open position, in which an insertion and removal of the contacting element (40, 50) from the supporting rail profile (15) is made possible, and a contacting position, in which the contact block (41, 42, 51, 52) with the connection contacts (43, 53) is extended laterally in order to contact the lines (25);

wherein the contacting element (40, 50, 60) comprises two contact blocks (41, 42, 51, 52) with connection contacts (43, 53) facing in opposite directions, wherein the two contact blocks (41, 42, 51, 52) are coupled such that they can be transferred from the open position into the contacting position while moving away from one another; and wherein the contacting element (40, 50) is configured such that a movement that is axially introduced into the supporting rail profile (15) is converted into a lateral movement of the contact blocks (41, 42, 51, 52).

4. The luminaire or electrical unit according to claim 3, wherein the two contact blocks (41, 42) are connected to one another via articulated arms (46, 48) that form a toggle joint (45).

5. The luminaire or electrical unit according to claim 4, wherein the toggle joint (45) is designed such that, upon application of pressure to the contact blocks (41, 42) in a direction opposite to the direction of insertion into the supporting rail profile (15), the contact blocks (41, 42) are transferred from the open position into the contacting position.

6. The luminaire or electrical unit according to claim 3, wherein the two contact blocks (51, 52) are supported on a carrier (31) of the luminaire (30) or the electrical unit by means of a wedge guide such that, when pressure is applied to the contact blocks (51, 52) in a direction opposite to the direction of insertion into the supporting rail profile (15), the contact blocks (51, 52) are forced from the open position into the contacting position by a wedge (55) arranged on the carrier (31).

7. The luminaire or electrical unit according to claim 3, wherein the two contact blocks (41, 42, 51, 52) are connected to one another via a tension spring (49, 59) that biases the contact blocks (41, 42, 51, 52) into the open position.

8. The luminaire or electrical unit according to claim 1, wherein the contact blocks (61, 62) comprise outwardly facing detent elements (64) for mechanical fastening to the supporting rail profile (15).

9. A luminaire (30) or electrical unit for connection to a supporting rail (10) comprising a supporting rail profile (15) having two lateral walls (16) and at least one busbar (20), which is arranged on one of the two inner faces of the lateral walls (16) of the supporting rail profile (15) and comprises electrically contactable lines (25);

wherein the luminaire (30) or the electrical unit comprises a contacting element (40, 50, 60) for electrically and mechanically connecting to the supporting rail (10), wherein the contacting element (40, 50, 60) is introducible into the supporting rail profile (15) and comprises connection contacts (42, 52, 62) which are mounted in an adjustable manner in order to bear against lines (25) of the busbar (20) in a state in which the contacting element (40, 50, 60) has been inserted in the supporting rail profile (15);

wherein the contacting element (40, 50, 60) comprises at least one linearly laterally adjustable contact block (41, 42, 51, 52, 61, 62) having connection contacts (43, 53, 63), which block is adjustable between an open position, in which an insertion and removal of the contacting element (40, 50, 60) from the supporting rail profile (15) is made possible, and a contacting position, in which the contact block (41, 42, 51, 52, 61, 62) with the connection contacts (43, 53, 63) is extended laterally in order to contact the lines (25); and wherein at least one of the contacts (43, 53, 63) is supported on the contact block (41, 42, 51, 52, 61, 62) in a height-adjustable manner.

10. The luminaire or electrical unit according to claim 1, wherein it is an LED bar luminaire.

11. An arrangement for light output with a supporting rail (10) comprising a supporting rail profile (15) having two lateral walls (16) and at least one busbar (20), which is arranged on one of the two inner faces of the lateral walls (16) of the supporting rail profile (15) and comprises electrically contactable lines (25), and a luminaire (30) or an electrical unit according to claim 1.

12. The arrangement for light output according to claim 11, wherein bus bars (20) are arranged on both lateral walls (16) of the supporting rail (10).

13. The luminaire or electrical unit according to claim 1 wherein at least one of the contacts (63) is supported on the contact block (61, 62) in a height-adjustable manner.

14. The luminaire or electrical unit according to claim 1, wherein the parallel guide (65) comprises a rib on one of the contact blocks that engages a slot-like recess on the other contact block.

15. The luminaire or electrical unit according to claim 1, wherein the parallel guide (65) comprises a pair of articulating arms (68) connected between the contact blocks (61, 62).

* * * * *